US006202371B1

(12) United States Patent
Natelli, Jr.

(10) Patent No.: US 6,202,371 B1
(45) Date of Patent: Mar. 20, 2001

(54) REINFORCED POLE WITH APPARATUS AND METHOD FOR ANCHORING

(76) Inventor: Anthony Mario Natelli, Jr., 20301 Martinsburg Rd., Dickerson, MD (US) 20842

( * ) Notice: Subject to any disclaimer, the term of this patent is extended or adjusted under 35 U.S.C. 154(b) by 0 days.

(21) Appl. No.: 09/317,830

(22) Filed: May 25, 1999

(51) Int. Cl.[7] ..... E02D 27/42

(52) U.S. Cl. ..... 52/170; 52/296; 52/730.1; 52/720.4; 52/736.3; 52/745.21; 52/740.4; 52/740

(58) Field of Search ..... 52/170, 297, 296, 52/730.1, 730.4, 736.3, 736.4, 745.18, 745.21, 740.1–740.5, 740; 109/82, 83, 85

(56) References Cited

U.S. PATENT DOCUMENTS

| | | | | |
|---|---|---|---|---|
| 2,099,126 | * | 11/1937 | Larsen | 156/256 |
| 3,349,531 | | 10/1967 | Watson . | |
| 3,621,663 | * | 11/1971 | Otani | 405/231 |
| 3,792,680 | * | 2/1974 | Allen | 116/173 |
| 3,972,529 | | 8/1976 | McNeil . | |
| 4,986,406 | | 1/1991 | Winsor . | |
| 5,339,594 | * | 8/1994 | Ventura-Berti | 52/736.3 |
| 5,572,846 | * | 11/1996 | Sosa | 52/736.4 |
| 5,666,774 | | 9/1997 | Commins . | |
| 5,803,223 | | 9/1998 | Lucas . | |
| 5,869,159 | * | 2/1999 | Padilla | 428/40.1 |

* cited by examiner

*Primary Examiner*—Christopher T. Kent
*Assistant Examiner*—Jennifer I. Thissell
(74) *Attorney, Agent, or Firm*—Stephen Christopher Swift; Swift Law Office

(57) ABSTRACT

A pole, such as for a parking meter, that is reinforced by a hardening compound applied to its surface, preferably in vertical strips, to prevent theft, and a method of anchoring the pole or other upright object. The hardening compound is preferably a solder that is applied to the external surface of the pole by welding. Once it cools, this hardening compound cannot be cut with an ordinary hacksaw. For esthetic purposes, and to prevent rust to the pole, a PVC pipe with a slightly greater diameter than the pole is placed over and around the pole. In a preferred embodiment, the pole is welded to a base plate, with hollow metal cylinders welded to and extending from an opposite surface of the plate. Holes are drilled (or otherwise formed) in a concrete (or other solid) surface, epoxy is inserted into the holes, the metal cylinders are inserted into the holes, and when the epoxy hardens the cylinders and base plate are bonded to the concrete. The base plate and cylinders can also be used to anchor other upright objects to a concrete surface.

22 Claims, 8 Drawing Sheets

REINFORCED POLE WITH APPARATUS AND METHOD FOR ANCHORING

BACKGROUND OF THE INVENTION

1. Field of the Invention

The present invention relates to poles, such as for parking meters, that are reinforced to prevent theft, and an apparatus and method for anchoring the parking meter poles in concrete.

2. Description of the Prior Art

Theft of coins from parking meters has become a serious problem in many cities. Thieves have gotten around previous anti-theft devices by sawing through the pole holding the meter, and taking the meter's head, coins and all, with them. In some cities, there have been large numbers of "decapitated" parking meters.

U.S. Pat. No. 3,349,531, issued on Oct. 31, 1967, to George H. Watson, discloses a frangible connector assembly for stanchions, poles, and standards, which may be used in parking meter poles, in which an anchoring bolt is embedded in concrete. The instant invention is distinguishable, in that in it the anchoring tubes are attached to the concrete by epoxy.

U.S. Pat. No. 3,972,529, issued on Aug. 3, 1976, to Walter F. McNeil, discloses reinforced tubular metallic materials, having recesses cut along their outer surfaces, into which graphite fiber strips are inserted. The instant invention is distinguishable, in that in it a hardening compound, rather than graphite fiber, is applied over the surface of the parking meter poles, rather than in recesses.

U.S. Pat. No. 4,986,406, issued on Jan. 22, 1991, to B. Drew Winsor, discloses an anti-theft parking meter anchoring device, for anchoring a parking meter head to the top of a support post. The instant invention is distinguishable, as it reinforces the pole itself.

U.S. Pat. No. 5,666,774, issued on Sep. 16, 1997, to Alfred D. Commins, discloses an adjustable support system for joining structural members, in which a threaded rod is secured in concrete by grout or epoxy. The instant invention is distinguishable, in that in it tubes or rods are welded to the base plate, need not be threaded, and in a preferred embodiment have hollow interiors to allow more effective bonding to the hardened epoxy.

U.S. Pat. No. 5,803,228, issued on Sep. 8, 1998, to Tom Lucas, discloses parking meter assemblies designed to prevent theft of coins in the parking meters, by means of reinforced steel sheets around the coin receptacle. The instant invention is distinguishable, in that it reinforces the pole to which the head of the parking meter is attached.

None of the above inventions and patents, taken either singly or in combination, will be seen to describe the instant invention as claimed.

SUMMARY OF THE INVENTION

The present invention is a pole, such as for a parking meter, that is reinforced by a hardening compound applied to its surface, preferably in vertical strips, and a method of anchoring the pole. The hardening compound is preferably a solder that is applied to the external surface of the pole by welding. Once it cools, this hardening compound cannot be cut with an ordinary hacksaw. For esthetic purposes, and to prevent rust to the pole, a PVC pipe with a slightly greater diameter than the pole is placed over and around the pole. In a preferred embodiment, the pole is welded to a metal plate, with hollow metal cylinders welded to and extending from an opposite surface of the plate. Holes are drilled in a concrete surface, epoxy is inserted into the holes, and the metal cylinders are inserted into the holes before the epoxy hardens. This makes it possible for the pole to be securely attached to the concrete surface, without the need for digging several feet below the surface.

Accordingly, it is a principal object of the invention to prevent parking meter theft.

It is another object of the invention to prevent theft of any object attached to a pole.

It is a further object of the invention to provide a convenient means for attaching parking meters to a concrete surface.

Still another object of the invention is to provide a means for securely attaching any upright object to a concrete surface.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is designed primarily to prevent theft from parking meters, though it may also have other applications.

Figure 1:
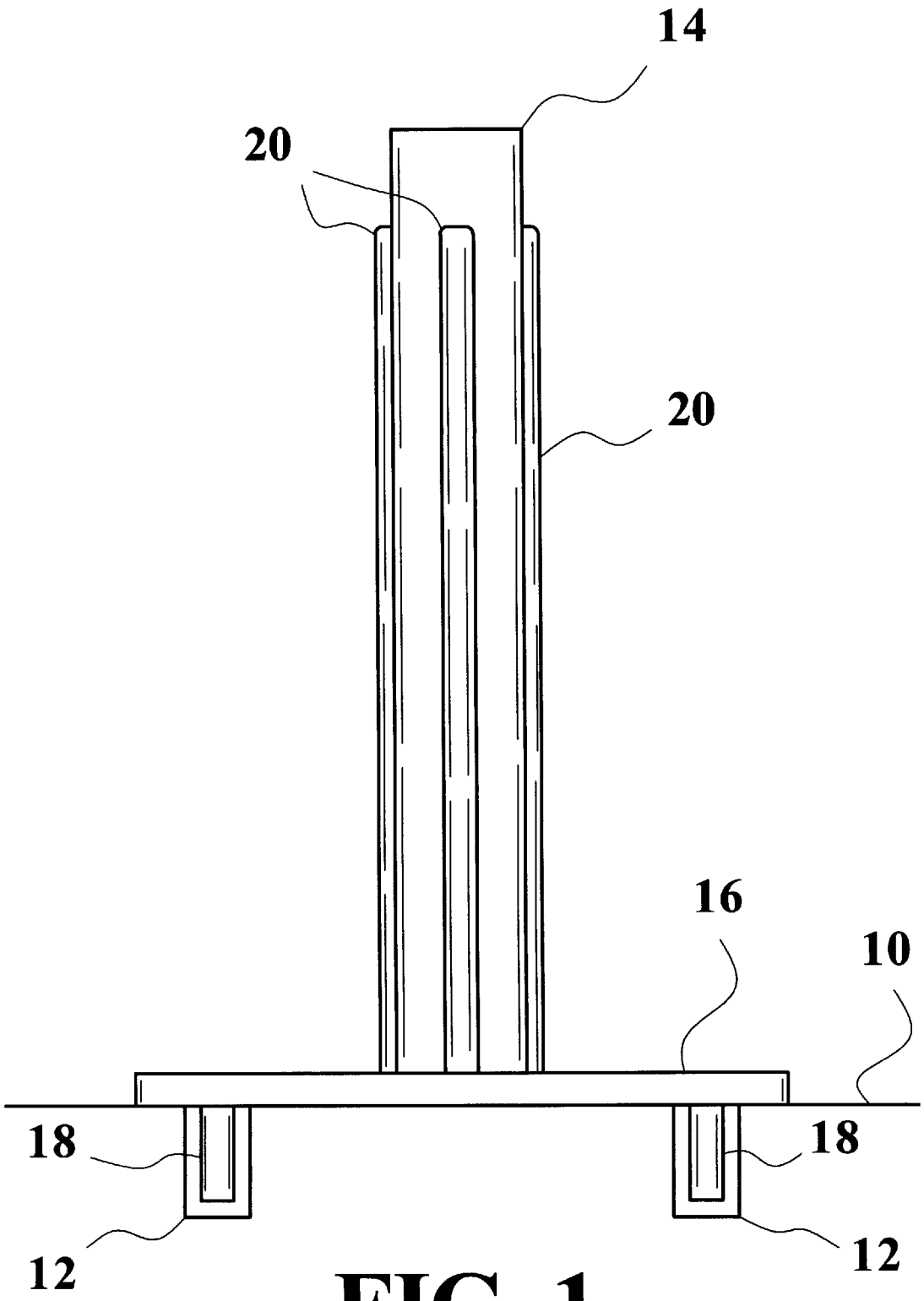
FIG. 1 is a front elevational view of the preferred embodiment of the invention, before the PVC pipe and parking meter head are attached.

FIG. 1 is a front elevational view of the preferred embodiment of the invention, before the polyvinyl chloride ("PVC") pipe and parking meter head are attached. The invention is retained on a concrete surface 10, into which holes 12 have been drilled. (Alternatively, the invention could be retained on another solid surface, such as rock or brick, or the holes could be formed by another method, such as the use of molds when the concrete is first poured.) A pipe 14 is welded to the top of a base plate 16. Tubes 18 are welded to the bottom of the base plate. Preferably, the pipe, base plate and tubes are all made of mild steel.

(Alternatively, bolts or other anchoring members could be used in place of tubes, and other means of bonding or attachment could be substituted for welding.) A hard-facing compound is applied to the surface of the pipe, preferably in vertical strips by arc welding. The hard-facing compound is preferably an alloy containing carbon, chromium, molybdenum, manganese, silicon, boron and vanadium, having a Rockwell hardness number of at least 60. (Such hard-facing compounds are commercially available.) The strips of hard-facing should run from the bottom end of the pipe to almost the top of the pipe, but should end a short distance from the top to allow the parking meter head to be inserted over the pipe. The strips of hard-facing are difficult to cut through without the use of conspicuous special equipment that would attract the attention of authorities, thus preventing theft of coins in the parking meter by cutting through the pipe and taking the head to a private location where the coins can be removed.

Figure 2:
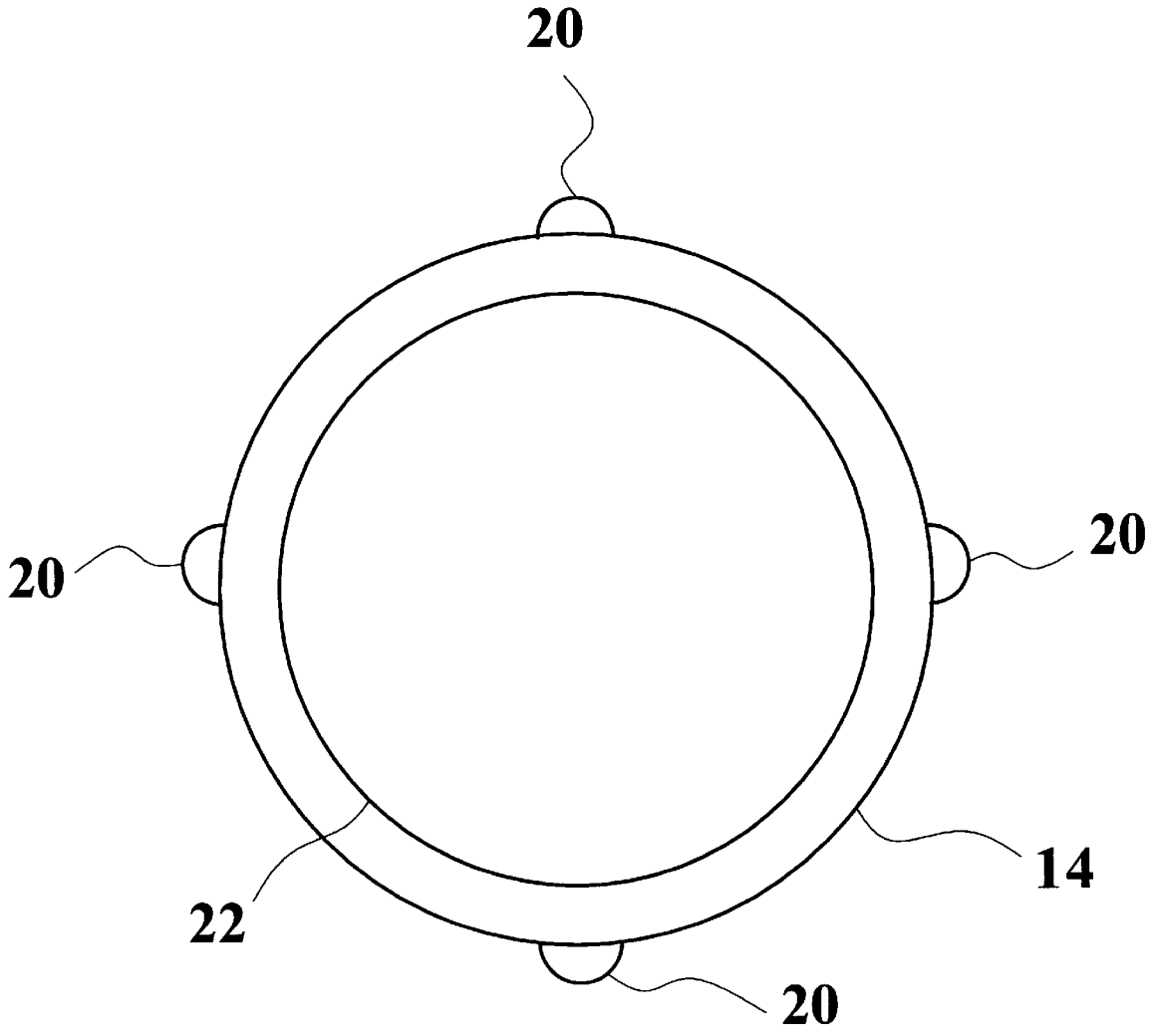
FIG. 2 is a top plan view of the steel pipe reinforced by the hard-facing.

FIG. 2 is a top plan view of the steel pipe 14 reinforced by the strips of hard-facing 20, showing the pipes hollow interior 22. Preferably, there should be at least four evenly spaced strips, to prevent a thief from being able to cut through a large angle of the pipe.

Figure 3:
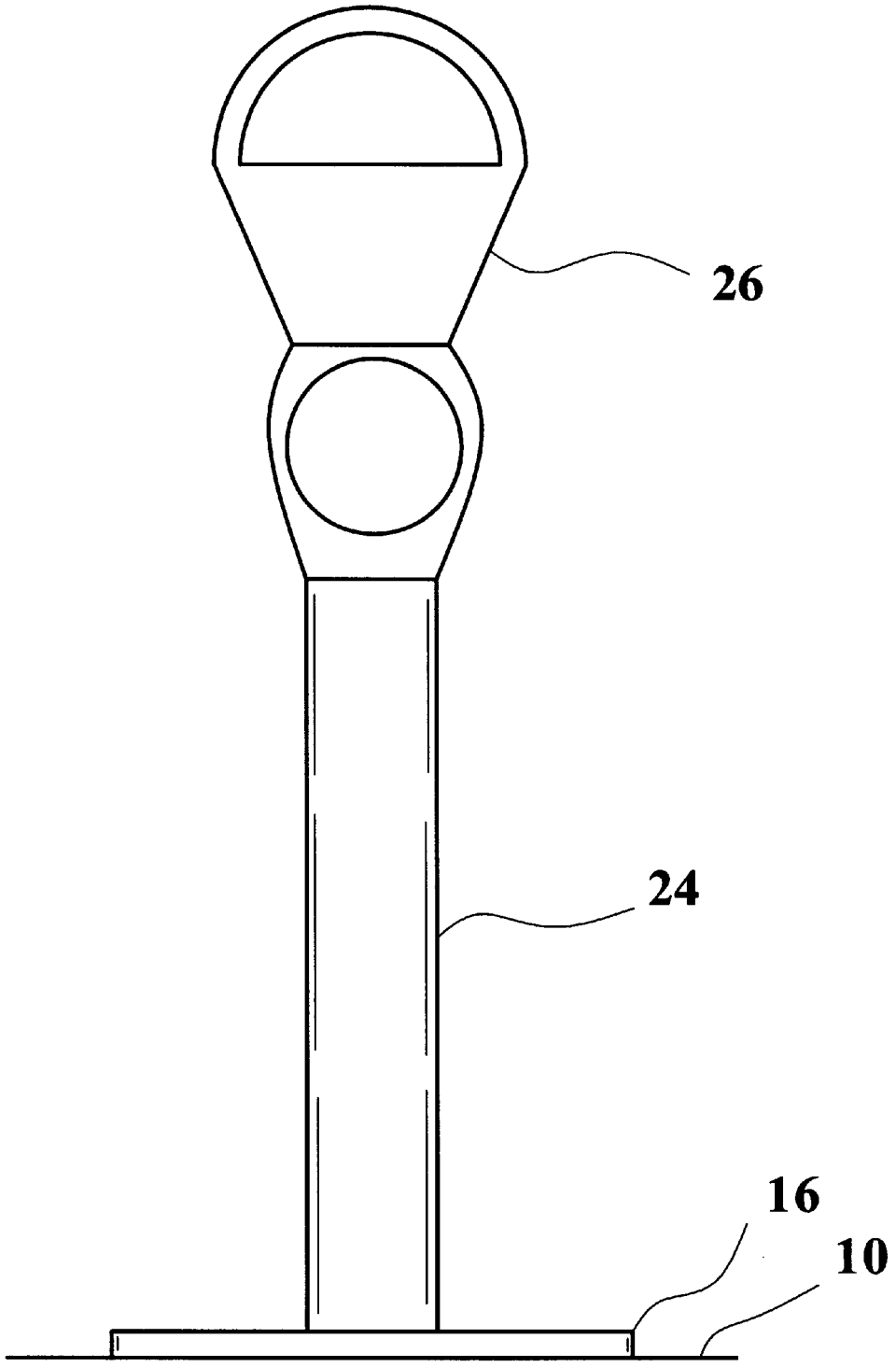
FIG. 3 is a front elevational view of the preferred embodiment of the invention, after the PVC pipe and parking meter head have been attached.

FIG. 3 is a front elevation view of the preferred embodiment of the invention, after the PVC pipe 24 and parking meter head 26 have been attached. Alternatively, two parking meter heads may be attached to the same pole (not shown in the drawings). The purpose of the PVC pipe is to improve the appearance of the parking meter, to prevent damage from chains used with bicycle locks, and to provide a maintenance-free surface. Alternatively, a pipe made of any other suitable waterproof substance could be used.

Figure 4:
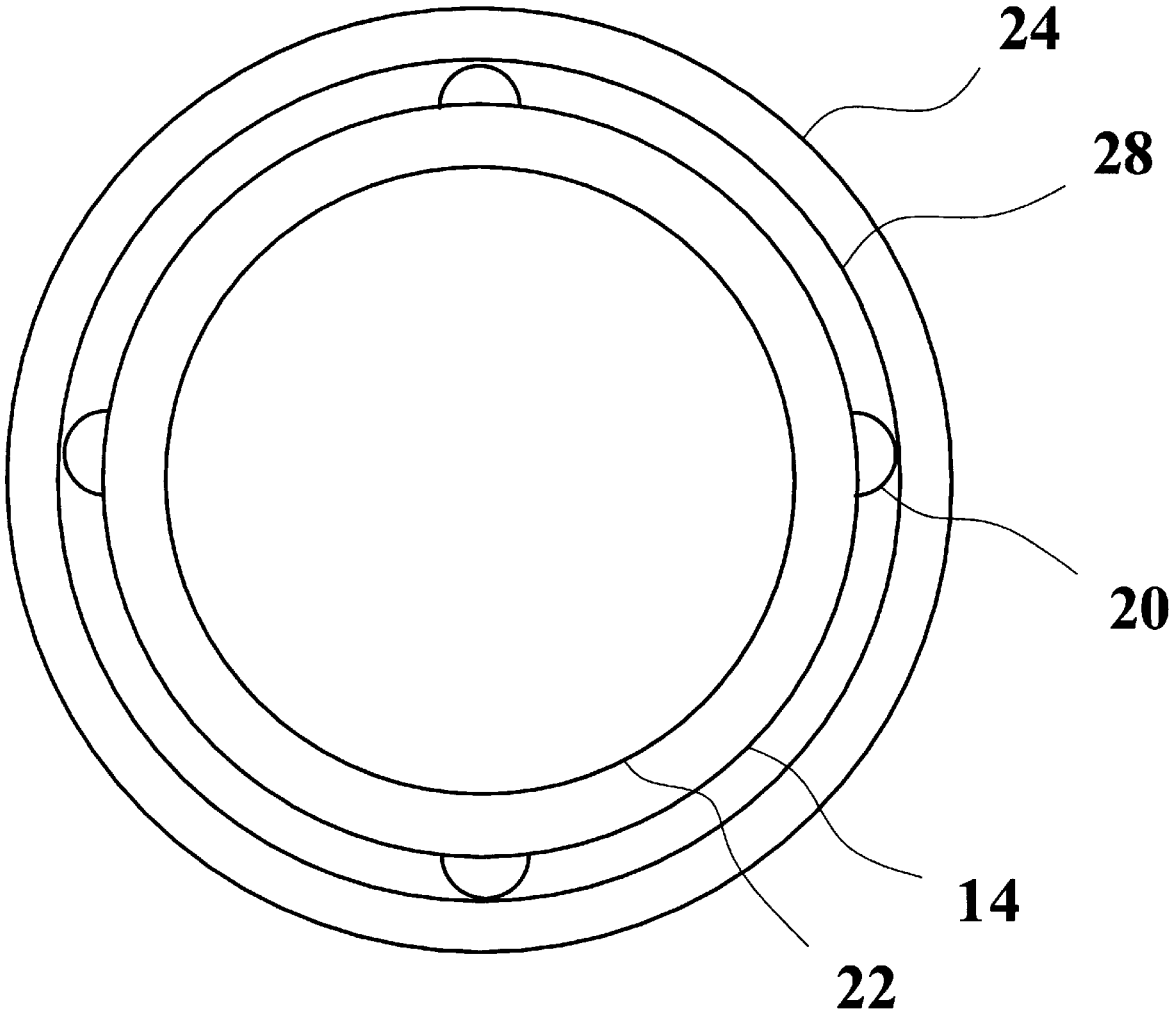
FIG. 4 is a top plan view of the reinforced steel pipe surrounded by the PVC pipe.

FIG. 4 is a top plan view, showing the metal pipe 14 with its hollow interior 22 and the strips of hard-facing 20, surrounded by the PVC pipe 24. Preferably, the interior surface of the PVC pipe should just touch the hard-facing, leaving a small gap 28 between the metal pipe and the PVC pipe.

Figure 5:
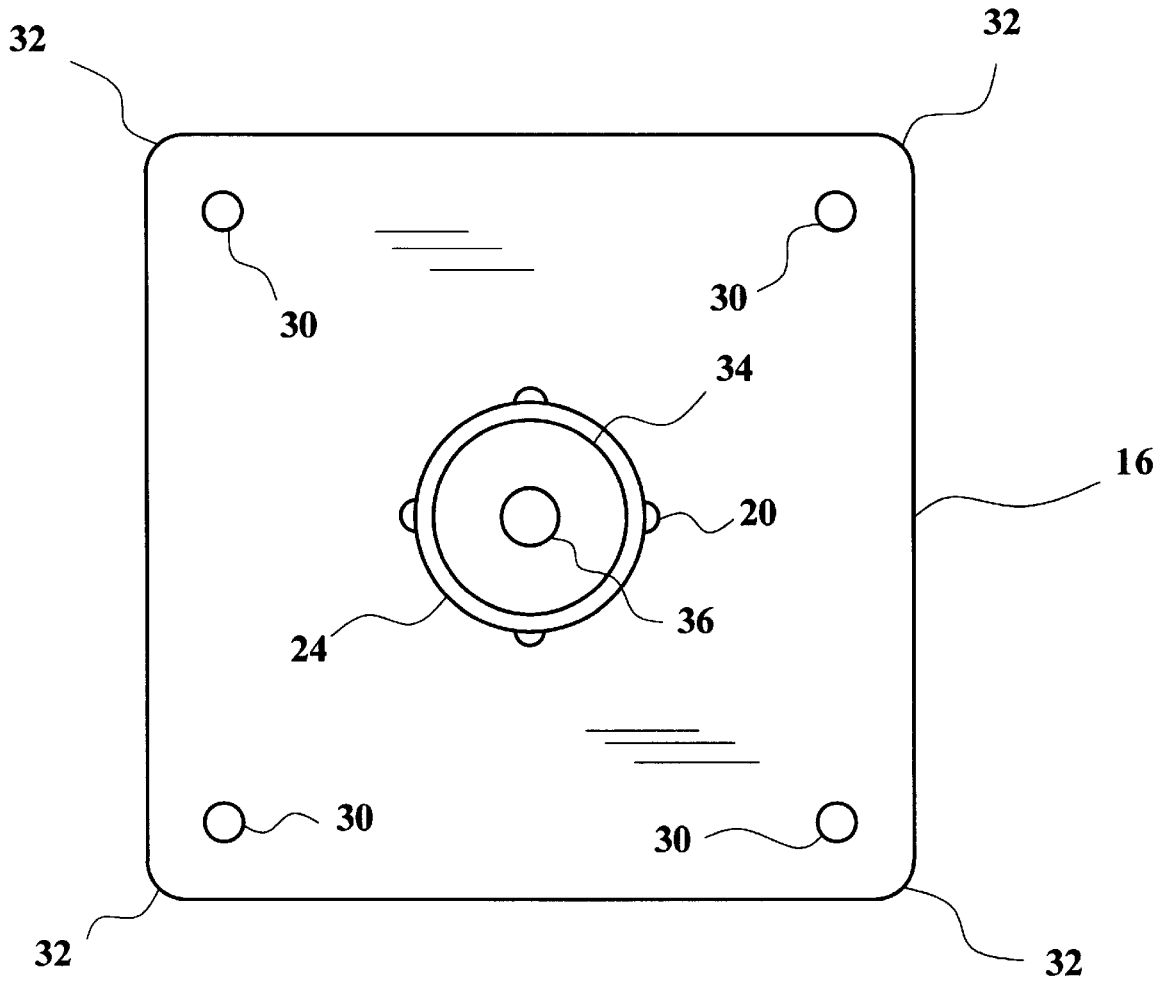
FIG. 5 is a top plan view of the preferred embodiment of the invention, before the PVC pipe and parking meter head are attached.

FIG. 5 is a top plan view of the preferred embodiment of the invention, before the PVC pipe and parking meter head are attached, showing four holes 30 that are drilled through the base plate 16 above the centers of the tubes welded to the other side of the plate. Also shown is a metal disk 34 that is welded inside the metal pipe near its top end. The disk has a threaded hole 36 through which a bolt (not shown in the drawings) is inserted to retain the parking meter head on the pole. Preferably, the corners 32 of the base plate should be rounded.

Figure 6:
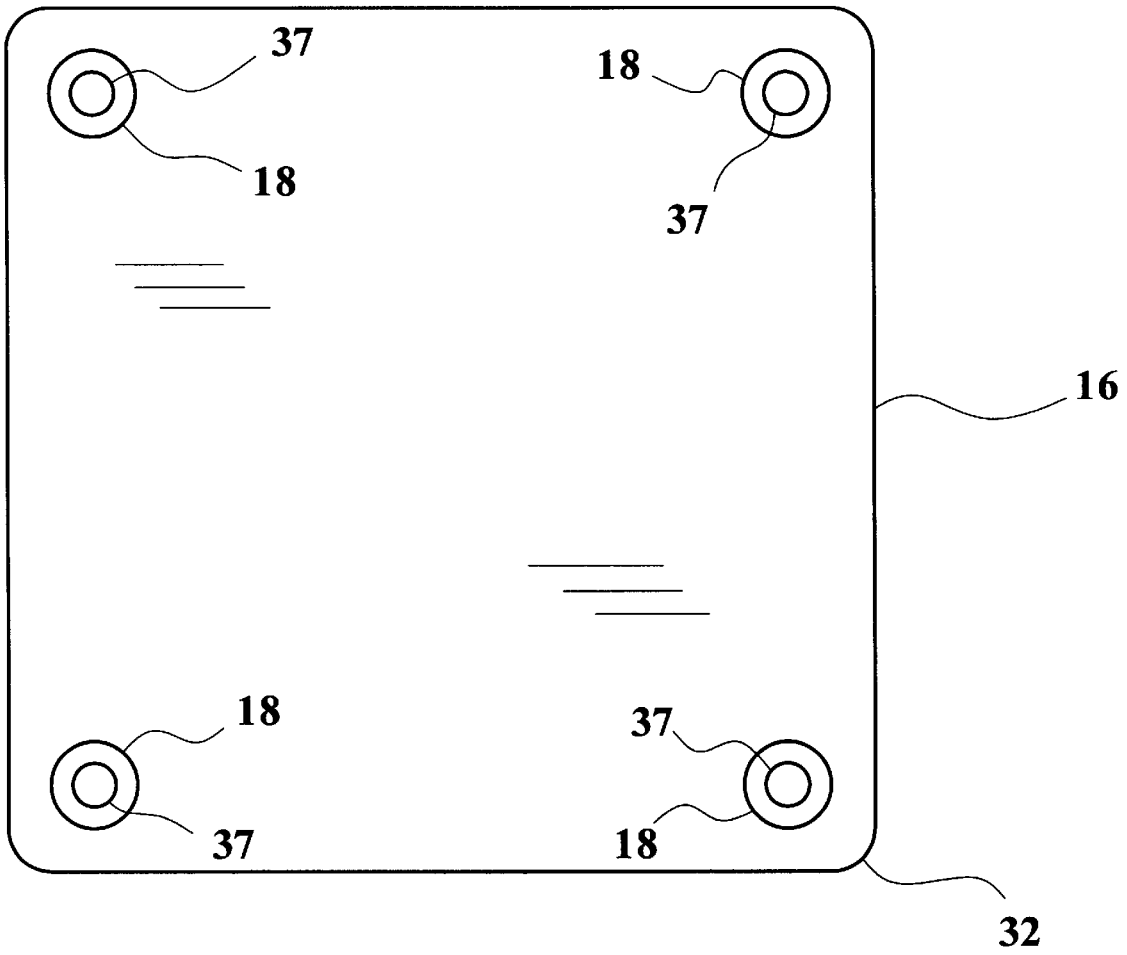
FIG. 6 is a bottom plan view of the preferred embodiment of the invention.

FIG. 6 is a bottom plan view of the preferred embodiment of the invention, showing the hollow interiors 37 of the tubes 18 welded to the base plate 16. Preferably, one tube should be adjacent to each corner of the base plate. Preferably, the base plate should be square, but rectangular, triangular, polygonal, circular and other shapes of base plates are within the scope of the invention.

Figure 7:
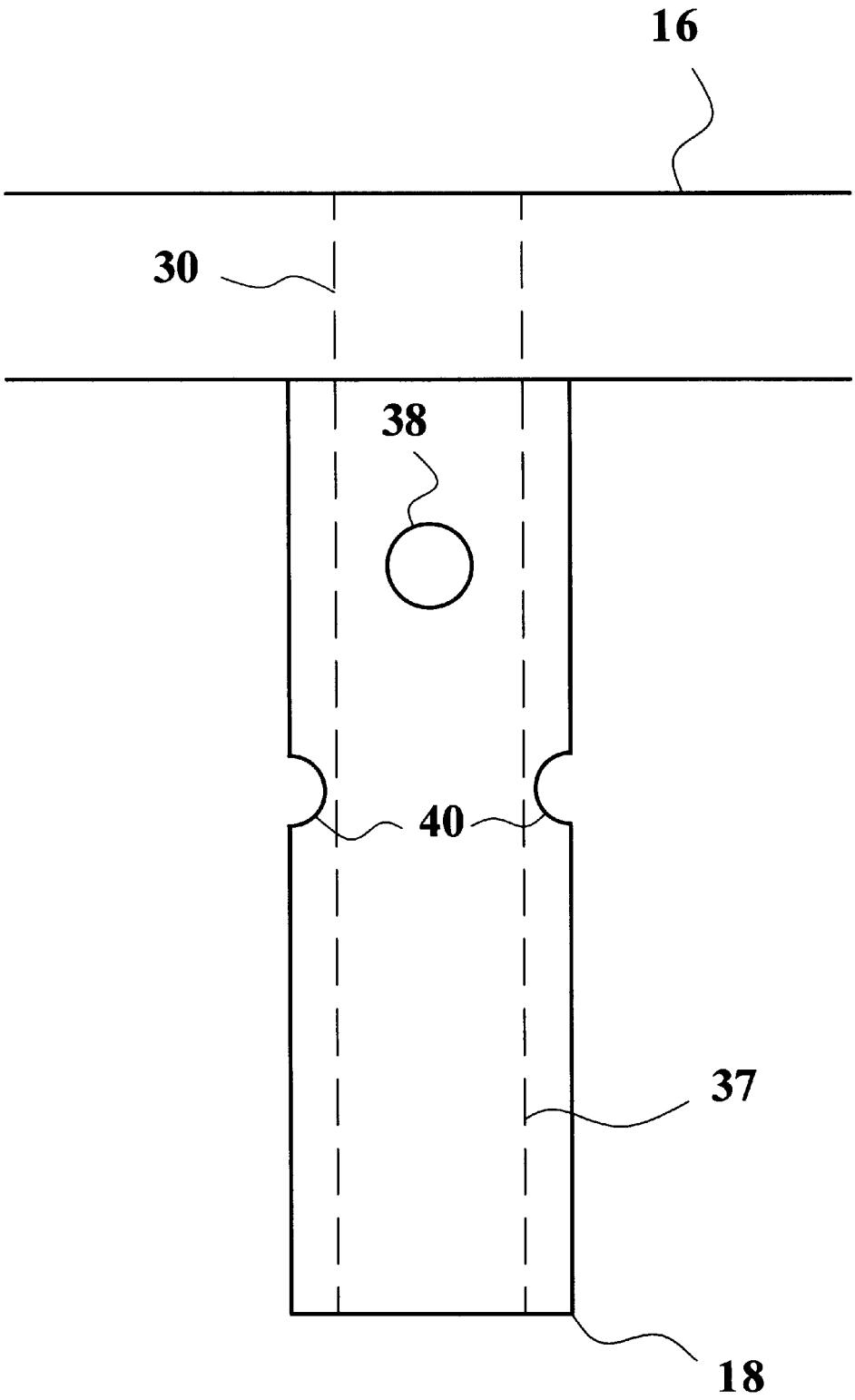
FIG. 7 is a detail view of one of the tubes attached to the base plate.
Figure 8:
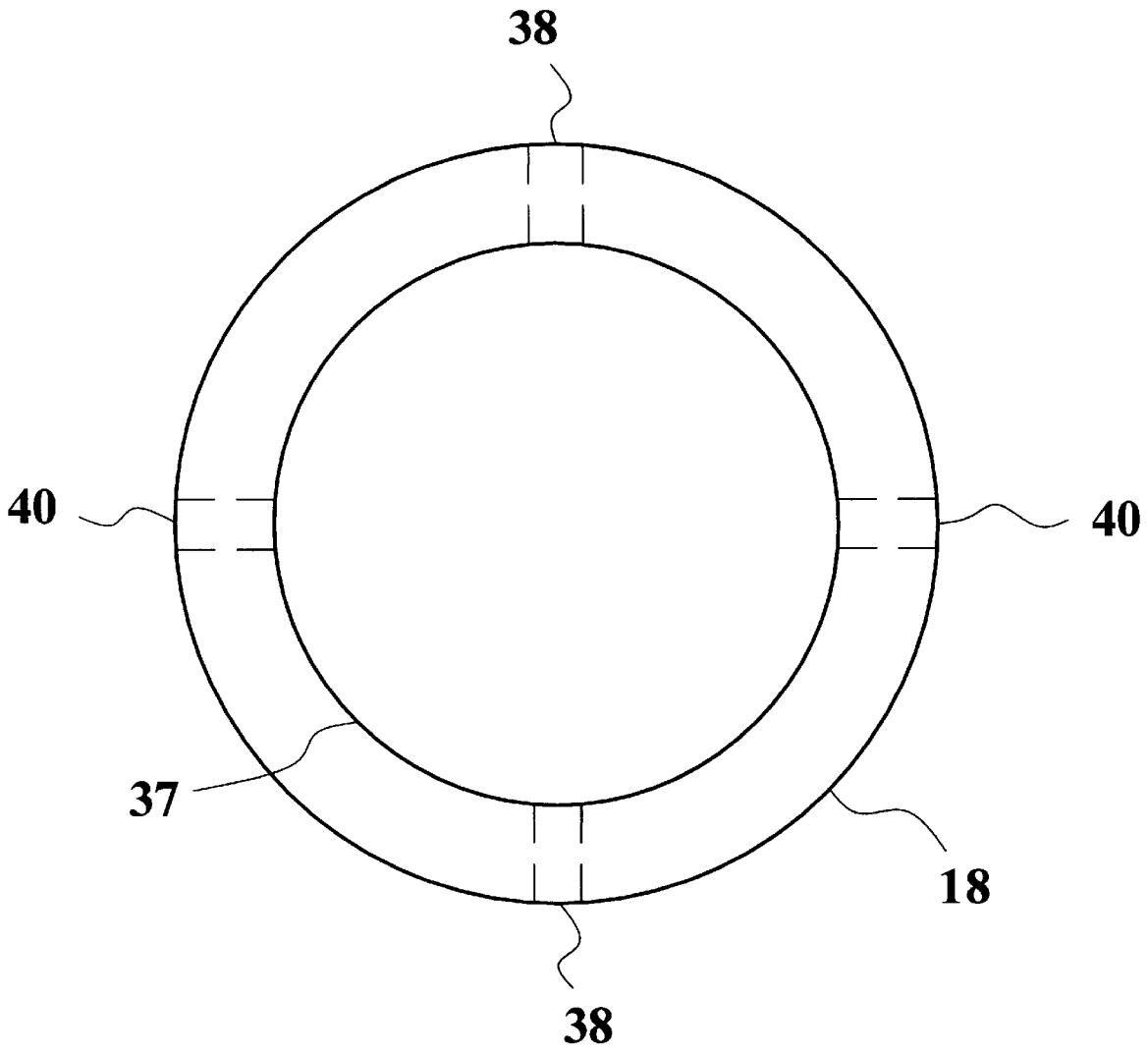
FIG. 8 is a bottom plan view of one of the tubes attached to the base plate.

FIG. 7 is a detail view of one of the tubes 18 attached to the base plate 18. The hollow interior 37 of the tube and the hole 30 through the base plate are indicated by broken lines. Also shown are transverse holes 38 and 40 drilled through the tube, at right angles to the axis of the tube and to each other. FIG. 8 is a bottom plan view of one of the tubes attached to the base plate, with the transverse holes 38 and 40 drilled through the tube at right angles indicated by broken lines.

When setting up the parking meter, the binder and catalyst of epoxy glue are mixed and then injected into the holes in the concrete (or other solid surface), and the tubes (or other anchoring elements) are then inserted into the holes. The hollow interiors and transverse holes of the tubes, and the holes in the base plate, serve to increase the surface area to which the epoxy can bind, thus increasing the strength of the bond between the metal and concrete. The holes in the base plate also allow air to escape from the tubes. The epoxy should be smoothed off at the tops of the holes in the base plate before it hardens, so that the epoxy filled holes will not be readily apparent. This method makes it possible to securely attach a parking meter (or other upright object, such as a stop sign or lamp post) to concrete, without having to drill several feet down (which could interfere with, utility lines). Another advantage of this method is that parking meters have a low enough center of gravity that other means of support are not necessary while the epoxy hardens. With larger objects, such as lamp posts, external support may be necessary while the epoxy hardens.

It is to be understood that the present invention is not limited to the sole embodiment described above, but encompasses any and all embodiments within the scope of the following claims.

I claim:

1. A structure for supporting an upright member on a solid surface, comprising:

a base plate having an upper surface and a lower surface;

means for retaining an upright member on the upper surface of the base plate;

anchoring members retained on the lower surface of the base plate; and a solid surface, with holes in the solid surface, and the anchoring members being retained within the holes by epoxy.

2. A structure for supporting an upright member on a solid surface according to claim 1, wherein the base plate and the anchoring members are made of metal, and the anchoring members are welded to the base plate.

3. A structure for supporting an upright member on a solid surface according to claim 2, wherein the solid surface is concrete.

4. A structure for supporting an upright member on a solid surface according to claim 3, wherein the anchoring members have solid interiors.

5. A structure for supporting an upright member on a solid surface according to claim 3, wherein the anchoring members are tubes with hollow interiors.

6. A structure for supporting an upright member on a solid surface according to claim 5, wherein there are holes in sides of the anchoring member, said holes passing from an exterior surface of the anchoring member to its hollow interior.

7. The reinforced pole according to claim 5, wherein:

the pole is retained on an upper surface of a base plate resting on the ground surface; and a plurality of anchoring members are welded to a lower surface of the base plate.

8. A method of securing an upright member to a concrete surface, comprising the steps of:

welding anchoring members to a first surface of a base plate;

forming one hole in the concrete surface for each anchoring member;

inserting epoxy into each hole;

placing the base plate on the concrete surface, in such a position that each anchoring member is inserted into one of the holes;

allowing the epoxy to harden in the holes, to bond the anchoring members to the concrete surface; and retaining the upright member on a second surface of the base plate.

9. A reinforced pole, comprising:

a metal pole; and a hard-facing applied in strips to a surface of the pole, said hard-facing having a hardness greater than that of the pole itself, and said hard-facing containing metallic elements.

10. The reinforced pole according to claim 9, wherein:

the surface of the pole that the hard-facing is applied to is an exterior surface; and the strips in which the hard-facing is applied to the pole are longitudinal strips.

11. The reinforced pole according to claim 10, wherein: the pole has a hollow interior.

12. The reinforced pole according to claim 11, wherein:

the pole is retained on a ground surface, in a position perpendicular to the ground surface, and the longitudinal strips are vertical relative to the ground surface.

13. The reinforced pole according to claim 12, wherein:

the pole is cylindrical, with a top end and a bottom end; and the longitudinal strips are evenly spaced, and each longitudinal strip runs from the bottom end of the pole to an area adjacent to the top end of the pole.

14. The reinforced pole according to claim 13, wherein:

the pole is retained on an upper surface of a base plate resting on the ground surface; and a plurality of anchoring members are welded to a lower surface of the base plate.

15. The reinforced pole according to claim 14, wherein:

the base plate and the anchoring members are made of metal; and the pole and anchoring members are welded to the base plate.

16. The reinforced pole according to claim 15, wherein the ground surface is concrete, holes are drilled into the concrete, and the anchoring members are inserted into the holes.

17. The reinforced pole according to claim 16, wherein the anchoring members are retained in the holes by epoxy.

18. The reinforced pole according to claim 17, wherein the anchoring members are tubes with hollow interiors.

19. The reinforced pole according to claim 18, wherein there are holes in sides of the anchoring members, said holes passing from an exterior surface of the anchoring member to its hollow interior.

20. The reinforced pole according to claim 19, wherein the pole is surrounded by a pipe made of a waterproof material.

21. The reinforced pole according to claim 20, wherein the pole has an upper end and a lower end, with a parking meter head retained on the upper end; and the base plate retained on the lower end.

22. The reinforced pole according to claim 21, wherein the number of longitudinal strips of hard-facing applied to the pole is four.

* * * * *